US012747092B1

(12) United States Patent
Fender

(10) Patent No.: US 12,747,092 B1
(45) Date of Patent: Sep. 29, 2026

(54) VEHICLE-MOUNTED FLUID TANKS AND METHODS OF MANUFACTURING THE SAME

(71) Applicant: Stout Manufacturing, LLC, Haltom City, TX (US)

(72) Inventor: James Chase Fender, Fort Worth, TX (US)

(73) Assignee: Stout Manufacturing, LLC, Halton City, TX (US)

( * ) Notice: Subject to any disclaimer, the term of this patent is extended or adjusted under 35 U.S.C. 154(b) by 183 days.

(21) Appl. No.: 18/589,989

(22) Filed: Feb. 28, 2024

Related U.S. Application Data

(60) Provisional application No. 63/597,735, filed on Nov. 10, 2023.

(51) Int. Cl.
*B65D 90/52* (2006.01)

(52) U.S. Cl.
CPC ..... *B65D 90/52* (2013.01)

(58) Field of Classification Search
CPC ..... B65D 90/52
USPC ..... 220/562, 4.14, 563
See application file for complete search history.

(56) References Cited

U.S. PATENT DOCUMENTS 2,530,819 A * 11/1950 Hamlin ..... B60K 15/00 137/259
2,569,493 A * 10/1951 Prior ..... B60K 15/00 280/833
2,569,494 A * 10/1951 Prior ..... B60K 15/00 280/833
2,758,845 A * 8/1956 Doyle ..... B60K 15/00 280/834
3,098,633 A * 7/1963 Price ..... B64D 37/04 220/563
3,870,172 A * 3/1975 Huber ..... E02F 9/2275 280/783
5,762,232 A * 6/1998 Green ..... F02B 63/04 220/564
6,145,691 A * 11/2000 Inaoka ..... B62J 35/00 220/608
6,293,420 B1 * 9/2001 Richter ..... B60K 15/077 220/563
6,381,823 B1 * 5/2002 Krejci ..... F17C 1/00 29/463

* cited by examiner

*Primary Examiner* — Jason L Vaughan
(74) *Attorney, Agent, or Firm* — Foley IP Law, PLLC

(57) ABSTRACT

A vehicle-mounted tank with an inner volume for storing liquid. The tank includes a tank base cut from sheet metal and bent to form a tank back wall and tank base wall substantially perpendicular with each other, a first tank side wall, and a second tank side. Where the tank base has a generally L-shaped cross-section. The tank includes a tank cover cut from sheet metal and bent to have a shape corresponding to the L-shaped cross-section of the tank base and is coupled with the tank base to form the inner volume. The tank includes a baffle assembly including a plurality of baffle plates each coupled with at least some of a plurality mounting beams, wherein each of the plurality of mounting beams is coupled with the first and second side walls to mount the baffle assembly within the inner volume of the tank.

11 Claims, 12 Drawing Sheets

VEHICLE-MOUNTED FLUID TANKS AND METHODS OF MANUFACTURING THE SAME

CLAIM OF PRIORITY TO PRIOR APPLICATION

This application claims priority to U.S. Provisional Patent Application No. 63/597,735, filed on Nov. 10, 2023 and entitled "Vehicle-Mounted Fluid Tanks and Methods of Manufacturing the Same". The entire disclosure of the above application is incorporated herein by reference.

FIELD OF THE INVENTION

The present invention relates generally to fluid tanks, and more particularly to liquid tanks mounted to field vehicles in the oil-and-gas field services industry, the construction industry, and similar industries for carrying fuel and other fluids needing to be transported between field locations.

BACKGROUND OF THE INVENTION

Fluid transport is critical to many different industries, and especially for the oil-and-gas industry. The oil-and-gas industry consists of various remote and difficult-to-access worksites. For example, well sites, drilling rigs, pump jacks, compression stations, treatment sites, storage facilities, and the like are often located in remote locations along ill-defined gravel or dirt roads. Since such sites are remote and often temporary, most resources required for operation of these sites must be brought in by oil-and-gas service vehicles. Such required resources include various fluids, such as, for example, diesel fuel for operating various pieces of equipment at these sites, water, cleaning liquids, and numerous other fluids. Various other industries require the use of these tanks, such as the construction industry and numerous other industries involving transporting liquids between filed locations.

Traditionally, for transporting liquids to these remote field sites, field service trucks have been equipped with tanks for holding the liquid. These tanks are traditionally offered in relatively standard sizes so as to fit within the truck bed area of mid-size, full-size or heavy-duty pickup trucks commonly used in the oil-and-gas, construction, and similar industries. Traditionally, these tanks are manufactured by cutting individual pieces of sheet metal for each side of tank and then welding the sheets together along the major corners of the tank. Needless to say, this process requires a substantial amount of welding of the numerous pieces, and results in tanks that have welds located along the corners of the tanks (i.e., where each side of the tanks meets an adjacent side).

As previously discussed, these service trucks must often endure rugged terrain in order to carry the liquid to its worksite destination. In doing so, the liquid tanks are subjected to significant vibrational loads. After continued use in these rugged environments, traditional tanks are known to commonly fail along the various corner-joint welds of the tank. As those with skill in the art will recognize, corner-joint welds are located in areas of high stress (i.e., the corners) which causes the welds to break down over time. Traditional tanks have corner joint welds on almost every major corner of the tank, which provides multiple opportunities for eventual failure.

Many traditional tanks also include baffle plates within their inner volume. As those with skill in the art will understand, baffle plates are configured to prevent the liquid held by the tanks from extreme levels of sloshing during travel. Thus, by preventing extreme sloshing, the baffle plates protect the walls of the tanks from enduring liquid sloshing loads from being applied against them during travel. The internal baffles of the traditional tanks are typically welded along the length of the baffle directly to inner walls of the tank, and these weld locations are known to tear the tank walls over continued use in rugged conditions due to the sloshing loads imparted on the baffle plates and the torque on the weld produced thereby.

The tank failures noted above are not only inconvenient and costly, but also ultimately dangerous to the operators when the tanks contain hazardous liquids, such as potent cleaning solvents or diesel fuel. Accordingly, there has been a long-felt need across various industries, such as in the oil-and-gas and construction industries, for vehicle-mounted fluid tanks built to withstand rugged terrain in which significant vibrational loads are consistently applied to the tank. Additionally, there is a need for a cost-effective and efficient method of manufacturing these fluid tanks, as all traditional manufacturing methods require numerous time-consuming welds and result in tank designs incapable of withstanding a rugged field environment.

BRIEF SUMMARY OF THE INVENTION

To address the various needs discussed above, disclosed is a vehicle-mounted liquid tank and method of manufacturing the same. The method includes cutting a tank base and a tank cover from flat sheet metal. The method further includes strategically bending the tank base to have a generally L-shaped cross-sectional area, and strategically bending the tank cover in the form of a general L-shape corresponding to the shape of the tank base. The method further includes welding outer-facing edges of the tank base with inner-facing surfaces of the tank cover and thereby forming the liquid tank having a fluidly-sealed and L-shaped inner volume for containing liquid. Where the bottom, back, and side surfaces of the tank are part of the tank base, and the top and the front surfaces of the tank are part of the tank cover.

According to various embodiments of this disclosure, disclosed is a vehicle-mounted tank with an inner volume for transporting a liquid. The tank comprises a tank base cut from sheet metal, wherein the tank base is bent to form: a tank back wall and tank base wall substantially perpendicular with each other, a first tank side wall formed by a first side section extending from the tank back wall welded with a second side section extending from the tank base wall, and a second tank side wall formed by a third side section extending from the tank back wall welded with a fourth side section extending from the tank base wall. Where the tank base has a generally L-shaped cross-section. The tank includes a tank cover cut from sheet metal and bent to have a shape corresponding to the L-shaped cross-section of the tank base, wherein inner surfaces of the tank cover are welded with outer edges of the tank base to form the inner volume. The tank includes a baffle assembly comprising a plurality of baffle plates each coupled with at least some of a plurality mounting beams, wherein each of the plurality of mounting beams is coupled with the first and second side walls to mount the baffle assembly within the inner volume.

According to various embodiments, the tank cover is bent to form a tank top wall substantially parallel with the tank base wall; a vertical middle wall extending substantially perpendicularly from the tank top wall and substantially parallel with the tank back wall; a horizontal middle wall extending substantially perpendicularly from the vertical middle wall and substantially parallel with the tank base wall; and a tank front wall extending substantially perpendicularly from the horizontal middle wall and substantially parallel with the tank back wall. According to various embodiments, the tank includes at one at least one liquid access port formed in the tank top wall and configured to allow access to the inner volume from outside of the tank. According to various embodiments, the inner surfaces of the tank cover are welded with the outer edges of the tank base using a T-joint welding method. According to various embodiments, each of the plurality of baffle plates is suspended within the inner volume of the tank by the mounting beams such that each of the plurality of baffle plates are free from direct contact with any of the walls of the tank. According to various embodiments, the plurality of baffle plates includes a plurality of horizontal baffle plates disposed in a horizontal section of the inner volume; and a plurality of vertical baffle plates disposed in a vertical section of the inner volume. According to various embodiments, each of the plurality of baffle plates: has a generally rectangular shape with a long axis and a short axis; includes a first beam through-hole disposed on a first end of the baffle along the long axis and a second beam through-hole disposed on a second end of the baffle along the long axis; and is configured to be coupled with one of the plurality of mounting beams by inserting the mounting beam through the first beam though-hole and with another one of the plurality of mounting beams by inserting the other mounting beam through the second beam though-hole. According to various embodiments, each of the plurality of baffle plates comprises a liquid flow through-hole, though which fluid in the tank is configured to freely flow through the baffle plate. According to various embodiments, each of the baffle plates is mounted within the inner volume to form a continuous gap between the baffle plate and the walls of the tank such that fluid held in the inner volume can freely flow past the baffle plate via the continuous gap. According to various embodiments, the tank is configured to be mounted to the bed area of a truck and be used for transporting liquids. According to various embodiments, the L-shaped cross-section of the tank is configured for receiving a truck bed toolbox.

According to various embodiments of this disclosure, disclosed is a method for manufacturing a vehicle-mounted tank with an inner volume for transporting a liquid. The method includes cutting a tank base and a tank cover from sheet metal; bending a first side section and a second side section of the tank base, disposed on a first side of the tank base, substantially ninety degrees about a first bend axis of the tank base; and bending a third side section and a fourth side section of the tank base, disposed on a second side of the tank base opposite of the first side of the tank base, substantially ninety degrees about a second bend axis of the tank base substantially parallel with the first bend axis. The method further includes bending an inner section of the base along a third access substantially perpendicular with the first axis and the second axis to form a tank back section and a tank bottom section from the inner section, wherein the bending along the third access further causes: an inner edge of the first side section to contact or nearly-contact an inner edge of the second side section to form a first tank side wall, an inner edge of the third side section to contact or nearly-contact an inner edge of the fourth side section to form a second tank side wall, and the tank base to have a generally L-shaped cross-section. The method further includes bending the tank cover along a fourth, fifth, and sixth bend axis of the tank cover, each tank cover bend axis substantially parallel with the third bend axis, to form a top wall, front wall, and first and second middle walls. Where: the first and second middle walls generally form an L-shape, the top wall extends perpendicularly from the first middle wall, and the front wall extends perpendicularly from the second middle wall. The method further includes welding the inner edge of the first side section with the inner edge of the second side section; welding the inner edge of the third side section with the inner edge of the fourth side section; and welding outer edges of the tank base with a bottom surface of the tank cover to form the tank with the inner volume. According to various embodiments, the method further includes mounting a baffle assembly within the tank base.

DETAILED DESCRIPTION OF THE INVENTION

The following descriptions relate to presently preferred embodiments and are not to be construed as describing limits to the invention, whereas the broader scope of the invention should instead be considered with reference to the claims, which may be now appended or may later be added or amended in this or related applications. Unless indicated otherwise, it is to be understood that terms used in these descriptions generally have the same meanings as those that would be understood by persons of ordinary skill in the art. It should also be understood that terms used are generally intended to have the ordinary meanings that would be understood within the context of the related art, and they generally should not be restricted to formal or ideal definitions, conceptually encompassing equivalents, unless and only to the extent that a particular context clearly requires otherwise.

For purposes of these descriptions, a few wording simplifications should also be understood as universal, except to the extent otherwise clarified in a particular context either in the specification or in particular claims. The use of the term "or" should be understood as referring to alternatives, although it is generally used to mean "and/or" unless explicitly indicated to refer to alternatives only, or unless the alternatives are inherently mutually exclusive. When referencing values, the term "about" may be used to indicate an approximate value, generally one that could be read as being that value plus or minus half of the value. "A" or "an" and the like may mean one or more, unless clearly indicated otherwise. Such "one or more" meanings are most especially intended when references are made in conjunction with open-ended words such as "having," "comprising" or "including." Likewise, "another" object may mean at least a second object or more.

The following descriptions relate principally to preferred embodiments while a few alternative embodiments may also be referenced on occasion, although it should be understood that many other alternative embodiments would also fall within the scope of the invention. It should be appreciated by those of ordinary skill in the art that the techniques disclosed in these examples are thought to represent techniques that function well in the practice of various embodiments, and thus can be considered to constitute preferred modes for their practice. However, in light of the present disclosure, those of ordinary skill in the art should also appreciate that many changes can be made relative to the disclosed embodiments while still obtaining a comparable function or result without departing from the spirit and scope of the invention.

Figure 1:
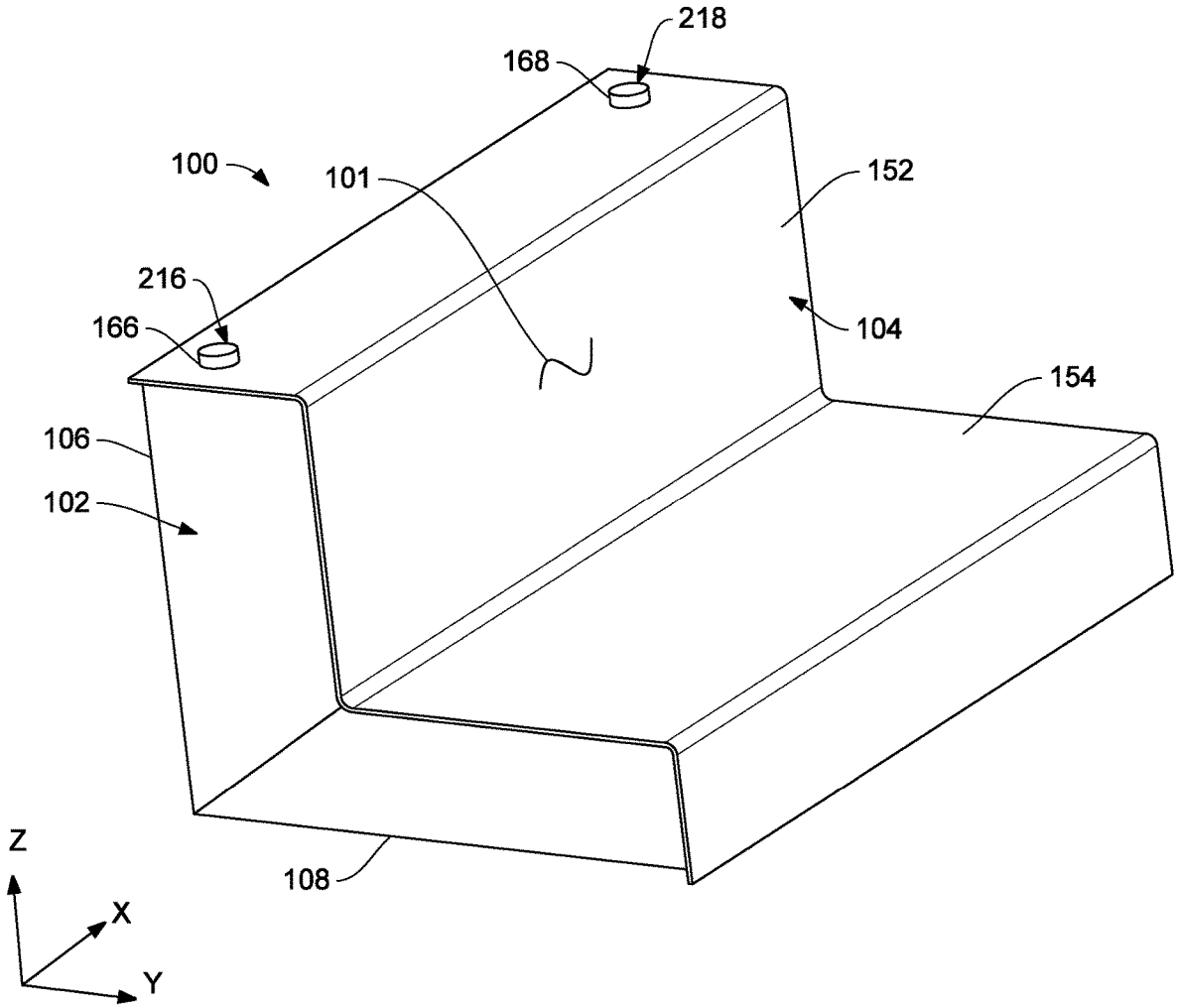
FIG. 1 illustrates a perspective view of a vehicle-mounted fluid tank, according to an embodiment of this disclosure.

FIG. 1 illustrates perspective view of a fluid tank 100 configured to be mounted to a vehicle, such as a truck bed area of a mid-size, full-size or super-duty vehicle. Tank 100 comprises a base 102 and a cover 104. As will be discussed in further detail below, each of the base 102 and the cover 104 is formed of a single sheet of metal and is strategically bent to form the geometries depicted such that, when the base 102 and cover 104 are joined together, the two pieces create an inner tank volume 101 for containing a liquid. Inner volume 101 is accessible from an outside of the tank 100 through fluid access assemblies 216, 218 accessible through holes 166, 168 on cover 104. Thus, the inner volume 101 can be filled or drained by using a pump and associated piping coupled with assemblies 216, 218, as will be discussed in greater detail below. Tank 100 can be mounted to a truck bed such that a back section 106 of base 102 is adjacent to the cab of the truck and a bottom section 108 of base 102 is mounted to the floor of the bed of the truck.

As previously mentioned, tank 100 is configured to be mounted to the bed area of a service truck and used for transporting liquids to service sites. Specifically, in some embodiments, thank 100 is utilized by those in the oil-and-gas, construction, and similar industries and is used to transport necessary liquids, such as water, cleaning solvents, or diesel fuel for example, to remote work sites such well sites, drilling rigs, pump jacks, compression stations, treatment sites, storage facilities, and the like. These work sites are often located in remote locations along ill-defined gravel or dirt roads, and thus the service truck has to traverse over rugged terrain, creating vibrational loads that must be absorbed by tank 100. As shown, tank 100 has a generally "L-shaped" cross-section. According to some embodiments, this shape is utilized for space savings within the bed of the truck. For example, in some embodiments, a toolbox is configured to be mounted to the two outer-facing, adjacent, perpendicular surfaces 152, 154 of cover 104. Accordingly, in these embodiments, the tank 100 and toolbox combination would have a generally rectangular or square shaped cross-section.

Figure 2:
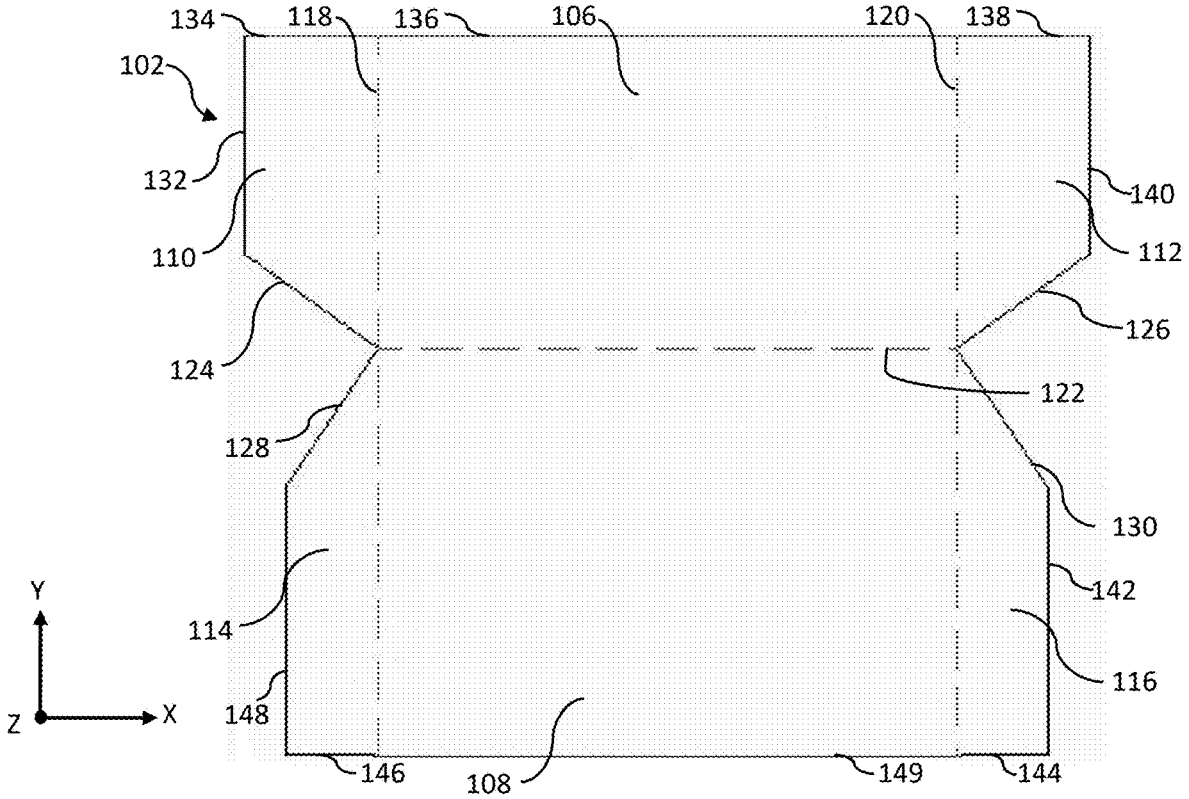
FIG. 2 illustrates a top view of a base plate of the fluid tank of FIG. 1 in an unfolded state.
Figure 3:
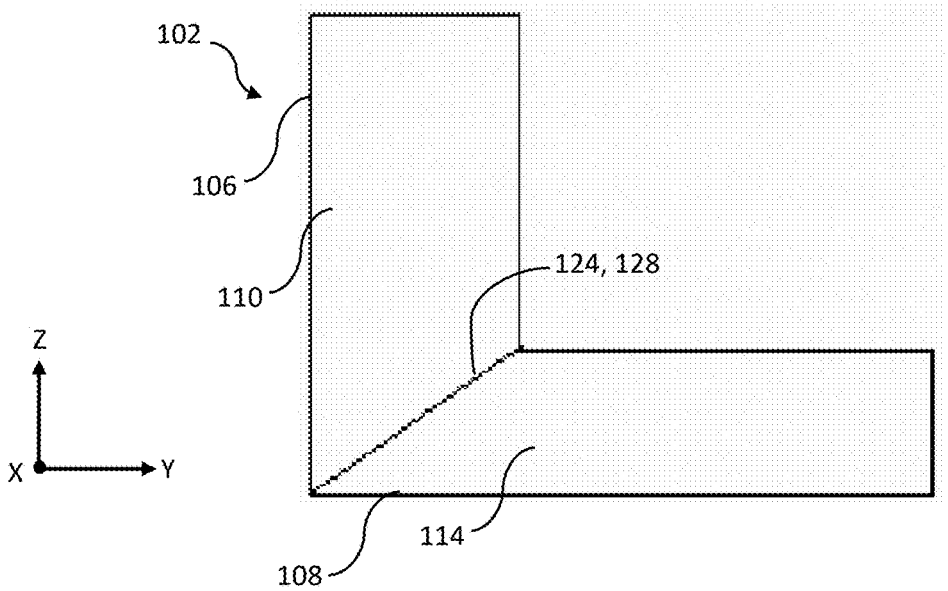
FIG. 3 illustrates a side view of the base plate of FIG. 2 in a bent state.
Figure 4:
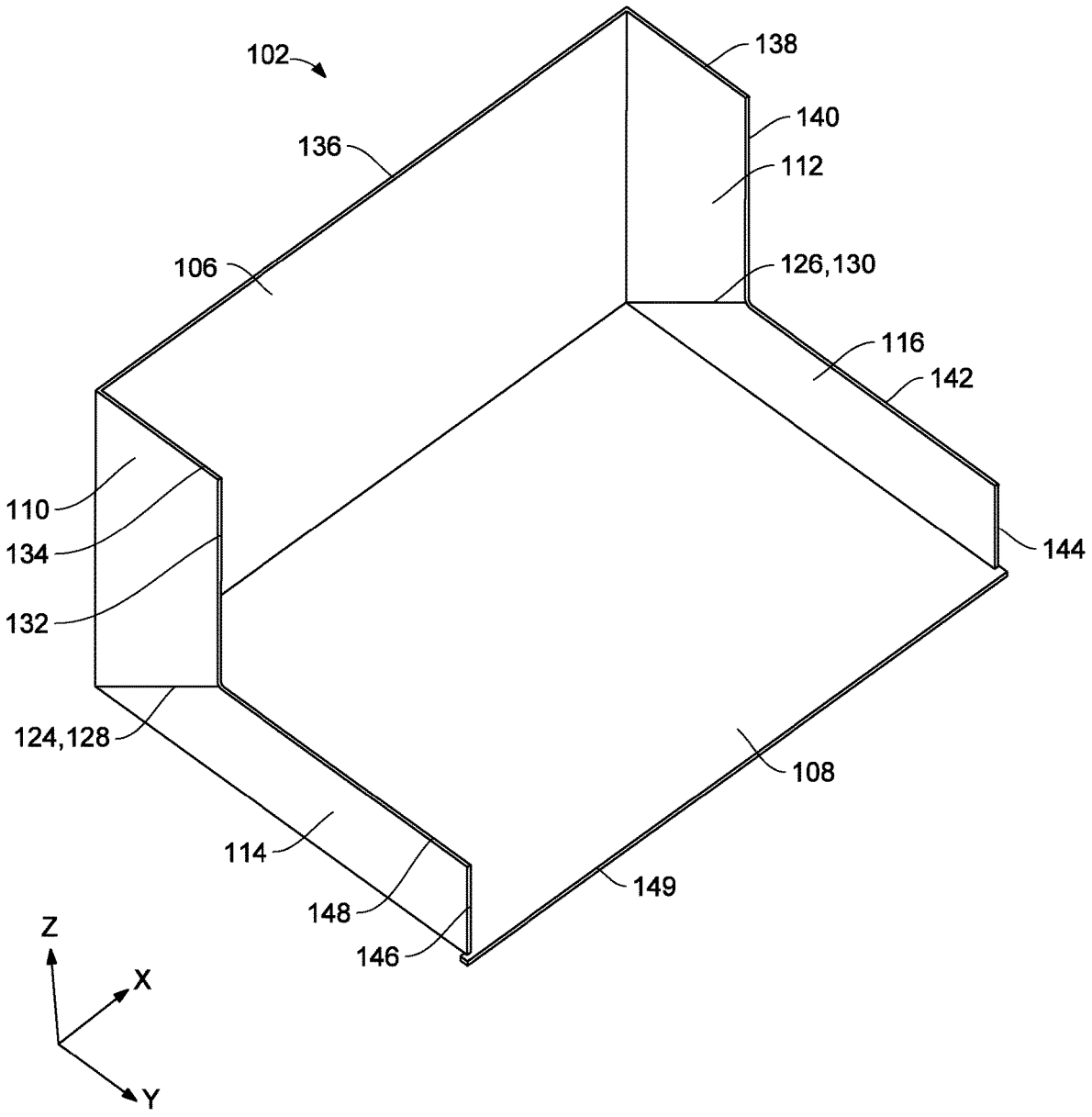
FIG. 4 illustrates a perspective view of the bent base plate of FIG. 3.

FIG. 2 illustrates a top view of base 102 when base 102 is in an unbent, flat state, before it is bent for being coupled with cover 104. Said another way, in FIG. 2, base 102 is a flat piece of metal cut from a piece of sheet metal. FIGS. 3 and 4 illustrate a side and a perspective view, respectively, of base 102 after being strategically bent in preparation for coupling with cover 104. As can be seen, base 102 is partitioned into a plurality of different sections defined by the edges of base 102 and also bend lines, illustrated in FIG. 2 with dashed lines. Specifically, base 102 has a back section 106, a bottom section 108, and four side sections 110, 112, 114, 116. To achieve the bent state illustrated in FIGS. 3 and 4, the various sections are bent along bend lines 118, 120, 122. Throughout the application, the bend lines may also be referred to as bend axes. As shown, bend axes 118 and 120 are substantially parallel with each other, and bend axis 122 is substantially perpendicular with bend axes 118, 120. Specifically, to form base 102 in its bent state, side section 110 and 114 are bent approximately 90 degrees about axis 118. Similarly, side sections 112, 116 are bent approximately 90 degrees about axis 120. Finally, back section 106 (and, thus, also side section 110, 112) is bent 90 degrees about axis 122 such that back section 106 and bottom section 108 are substantially perpendicular. Those with skill in the art will understand how the bending described transforms the flat base 102 depicted in FIG. 2 to the bent base 102 depicted in FIGS. 3 and 4.

For each side section 110, 112, 114, 116, the outer edge of the side section terminating at axis 122 is a notched edge, 124, 126, 128, 130. Thus, as can be seen in FIGS. 3 and 4, in base's 102 bent state, adjacent edges 124, 128 and 126, 130 are brought into contact with each other in some embodiments, or at least into very close proximity to each other in other embodiments. Thus, when base 102 is in its bent state, edge 124 is welded to edge 128 and edge 126 is welded with edge 130 to fluidly seal the inner volume 101 of tank 100. In some embodiments, an additional metal plate piece is welded over where edges 124 and 128 meet and where edges 126 and 130 meet in order to fluidly seal the inner volume 101 of tank 100. In addition to edges 124, 126, 128, 130, base plate 102 has additional outer edges 132-149. Specifically, as will be discussed in greater detail below, in some embodiments, each of edges 132-148 are coupled with inner facing surfaces cover 104.

Figure 5:
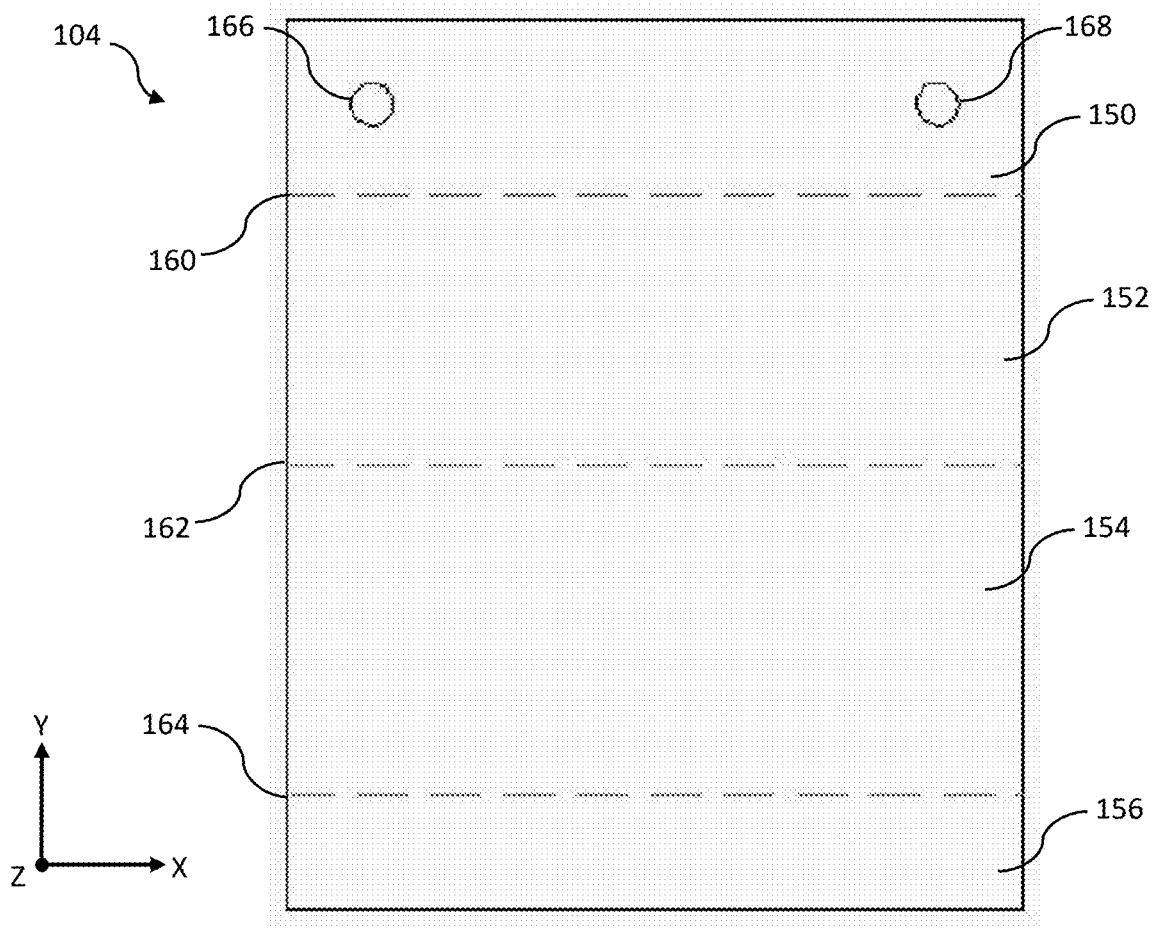
FIG. 5 illustrates a top view of a cover of the fluid tank of FIG. 1 in an unfolded state.
Figure 6:
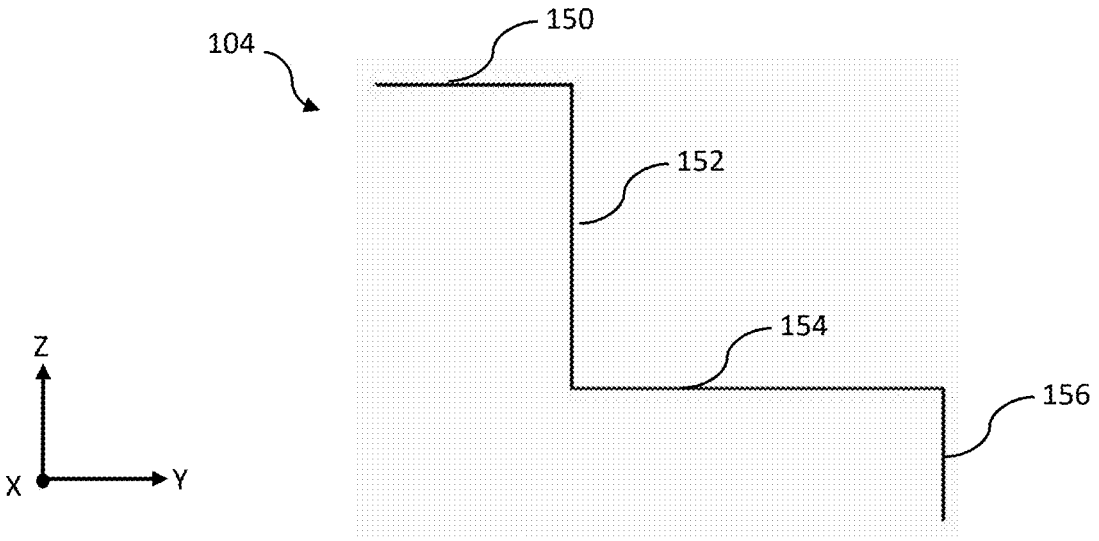
FIG. 6 illustrates a side view of the cover of FIG. 5 in a bent state.

FIG. 5 illustrates a top view of cover 104 when cover 104 is in an unbent, flat state, before it is bent for being coupled with base 102. Said another way, in FIG. 5, cover 104 is a flat piece of metal cut from a piece of sheet metal. FIG. 6 illustrates a side view of cover 104 after being strategically bent in preparation for coupling with base 102. As can be seen, cover 104 is partitioned into a plurality of different sections defined by the edges of cover 104 and also bend lines 160, 162, 164 illustrated in FIG. 5 with dashed lines. Specifically, cover 104 has a top section 150, a middle vertical section 152 (named "vertical" based on section's 152 vertical orientation when cover 104 is in its bent state as shown in FIG. 6), middle horizontal section 154 (named "horizontal" based on section's 154 horizontal orientation when cover 104 is in its bent state shown as in FIG. 6) and front section 156. To achieve the bent state illustrated in FIG. 6, the various sections are bent along bend lines 160, 162, 164. Throughout the application, the bend lines may also be referred to as bend axes. As shown, bend axes 160, 162, 164 are all substantially parallel with each other.

Specifically, to form cover 104 in its bent state, vertical section 152 is bent approximately 90 degrees about bend axis 162 such that an approximate 90-degree angle is formed between the outer-facing surface of vertical section 152 and the outer-facing surface of horizontal section 154 (as shown in FIG. 6). Top section 150 is bent approximately 90 degrees about bend axis 160 such that an approximate 90-degree angle is formed between the inner-facing surface of top section 150 and the inner-facing surface of vertical section 152 (as shown in FIG. 6). Front section 156 is bent approximately 90 degrees about bend axis 164 such that an approximate 90-degree angle is formed between the inner-facing surface of front section 156 and the inner-facing surface of horizontal section 154 (as shown in FIG. 6). Those with skill in the art will understand that all reference to "inner-facing" and "outer-facing" surfaces of the various sections of cover 104 are in reference to the orientation of the tank 100. Said another way, all "inner-facing" surfaces face the inner volume 101 of tank 100 while all "outer-facing" surfaces are open to the exterior of tank 100. Those with skill in the art will understand how the bending described transforms the flat cover 104 depicted in FIG. 5 to the bent cover 104 depicted in FIG. 6.

Additionally, top surface 150 comprises tank access through-holes 166, 168 for an operator to use for filing and emptying of liquid from thank 100. Specifically, for example, one of one of liquid access assemblies 216, 218, accessible by 166, 168, can be coupled with tubing and pumping equipment for emptying/filling tank 100 of the liquid held within while the other liquid access assembly 216, 218 is used to vent tank 100 and maintain a constant pressure during the emptying/filling.

Figure 7:
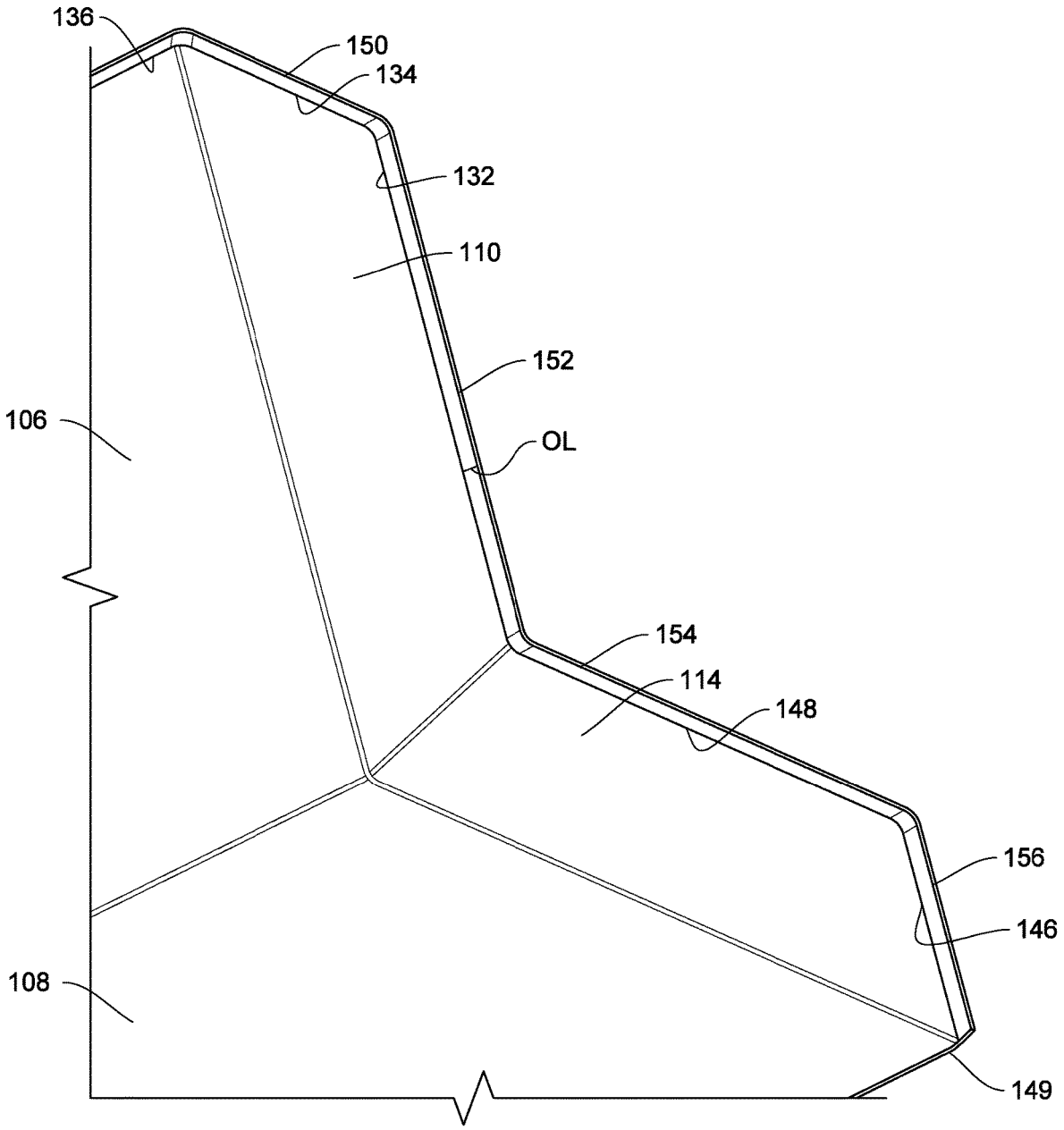
FIG. 7 illustrates an underside perspective view of the fluid tank of FIG. 1.

FIG. 7 illustrates an underside perspective view of a section of tank 100. Specifically, FIG. 7 illustrates how cover 104 and base 102 are aligned and coupled together. Since tank 100 is symmetrical about a center vertical axis, although FIG. 7 illustrates just one side of the tank 100, those with skill in the art will recognize that the other side of the tank 100 is mirror image of what is shown. Cover 104 is placed on base 102 such that the bottom (or inner-facing) surface of section 150 contacts edges 136, 134 as shown (as well as corresponding edge 138 on the other side of the tank 100). The bottom/inner-facing surface of section 152 is placed against edge 132 as shown (as well as corresponding edge 140 on the other side of the tank). The bottom/inner-facing surface of section 154 is placed against edge 148 as shown (as well as the corresponding edge 142 on the other side of the tank). The bottom/inner-facing surface of section 156 is placed against edge 146 as shown (as well as corresponding edge 144 of the other side of the tank).

As can be seen, cover 104 is wider than the width of the base 102 such that all edges 132-148 are disposed against an inner-facing surface of cover 104. Cover 104 overhangs base 102 by a sufficient overhang length OL to allow sufficient room for welding of cover 104 and base 102 from the outside of the tank 100. In some embodiments, the OL is 0.375 inch, and in some embodiments the OL is between 0.25 inch to 0.5 inch. However, those with skill in the art will understand OL can be greater than 0.5 inch or less than 0.25 inch without departing from the scope of this disclosure. Thus, to sealingly couple base 102 and cover 104, each of edge 132-148 can be welded to the corresponding inner-facing surface of cover 104 by any commonly known T-joint welding method. Additionally, as shown, edge 149 extends past an outer facing surface of section 156 such that a T-joint weld can be used to couple edge 149 with front surface 156. As previously discussed, those with skill in the art will understand the terminology of "inner-facing surfaces" and "outer-facing surfaces" used throughout this description. Specifically, inner-facing surfaces are surfaces of the various walls/sections of tank 102 and cover 104 facing inner volume 101, while outer-facing surfaces are surfaces of the various walls/sections facing the exterior of the tank (i.e., opposite of the inner-facing surface).

Those with skill in the art will recognize the various benefits associated with welding tank 100 together using the T-joint welds discussed. As previously discussed, traditional vehicle-mounted tanks are welded together at the major corners of the tank using corner-joint welds, which are known to fail in service in the oil fields due to the stresses of driving on rugged terrain being enhanced at the corners of the tank. Tank 100 utilizes bends rather than welds at the major corners of the tank and thus has solid metal rather than welds at areas of the tank experiencing the greatest amounts of stress. Said another way, tank 100 moves all welding to areas of the tank with less stress than traditional tanks. Further, tank 100 incorporates T-joint welds, which are stronger and more robust than the corner-joint welds traditionally employed on similar tanks.

Base 102 and cover 104 are described herein as having various different sections. Many of these sections may be described as "walls" of the tank 100 throughout the specification. For example, section 108 of base 102 may be referred to here as a tank base or bottom wall. Section 106 of base 102 may be referred to as a tank back or rear wall. As will be discussed in greater detail below, section 110 and 114 of base 102 together may referred to as a first tank side wall 170. As will be discussed in greater detail below, section 112 and 116 of base 102 together may referred to as a second tank side wall 172. Section 150 of cover 104 may be referred to as a tank top wall. Section 152 of cover 104 may be referred to as a tank vertical middle wall. Section 154 of cover 104 may be referred to as a tank horizontal middle wall. Section 156 of cover 104 may be referred to as a tank front wall.

Figure 8:
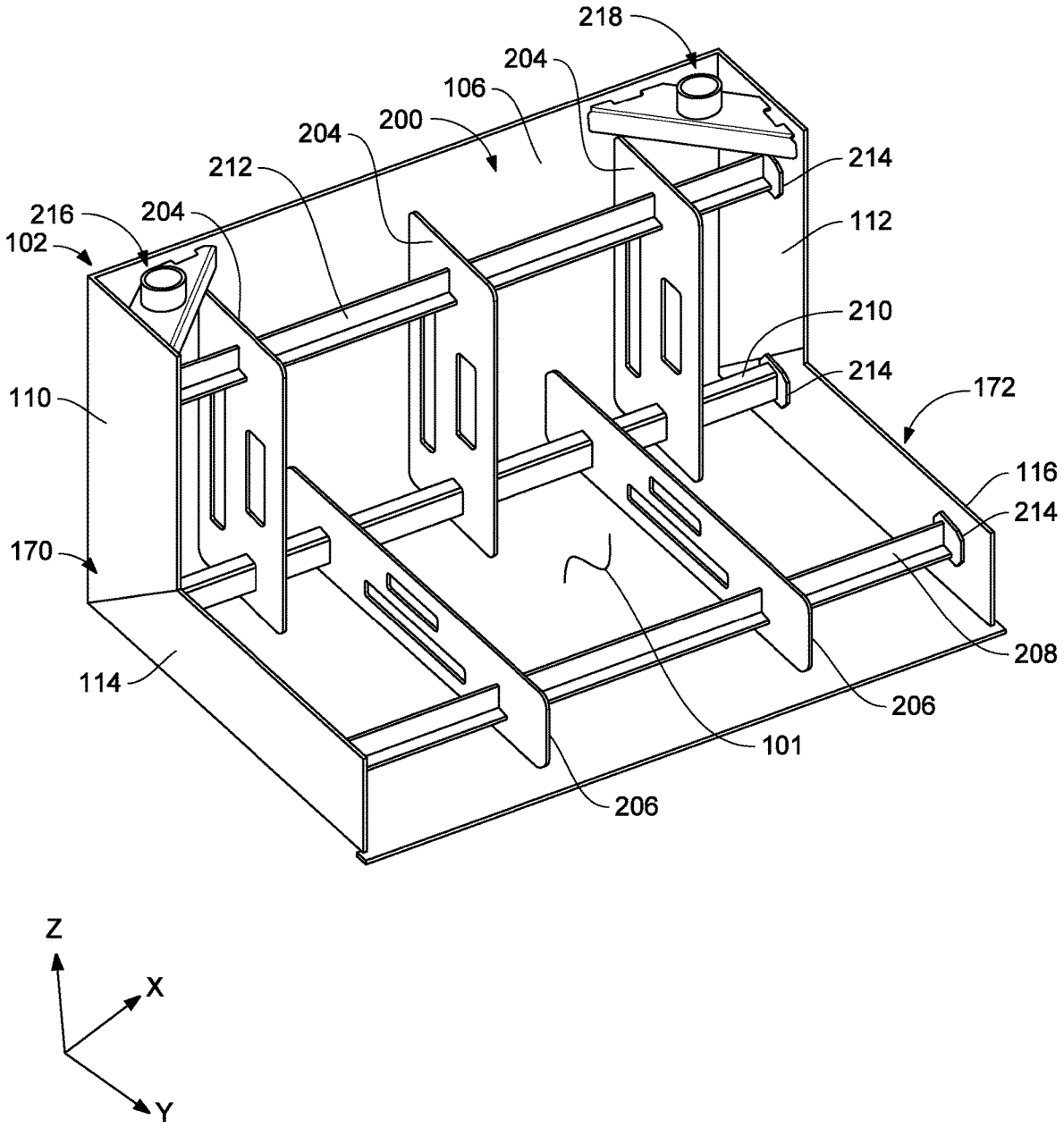
FIG. 8 illustrates a perspective view of the tank of FIG. 1 with the cover removed to expose a baffle assembly disposed withing an inner volume of the tank.
Figure 9:
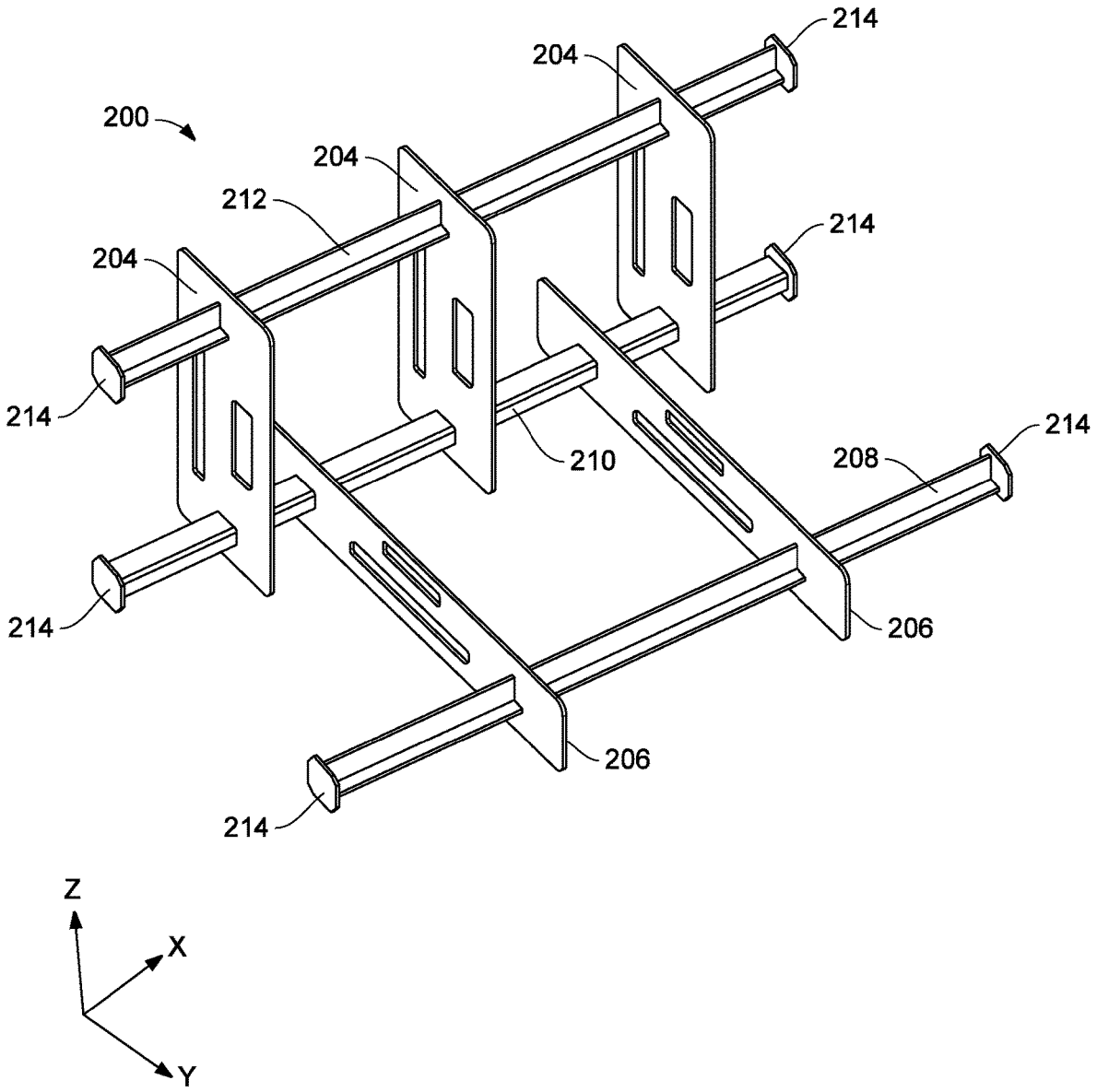
FIG. 9 illustrates a perspective view of the baffle assembly of FIG. 8.
Figure 10:
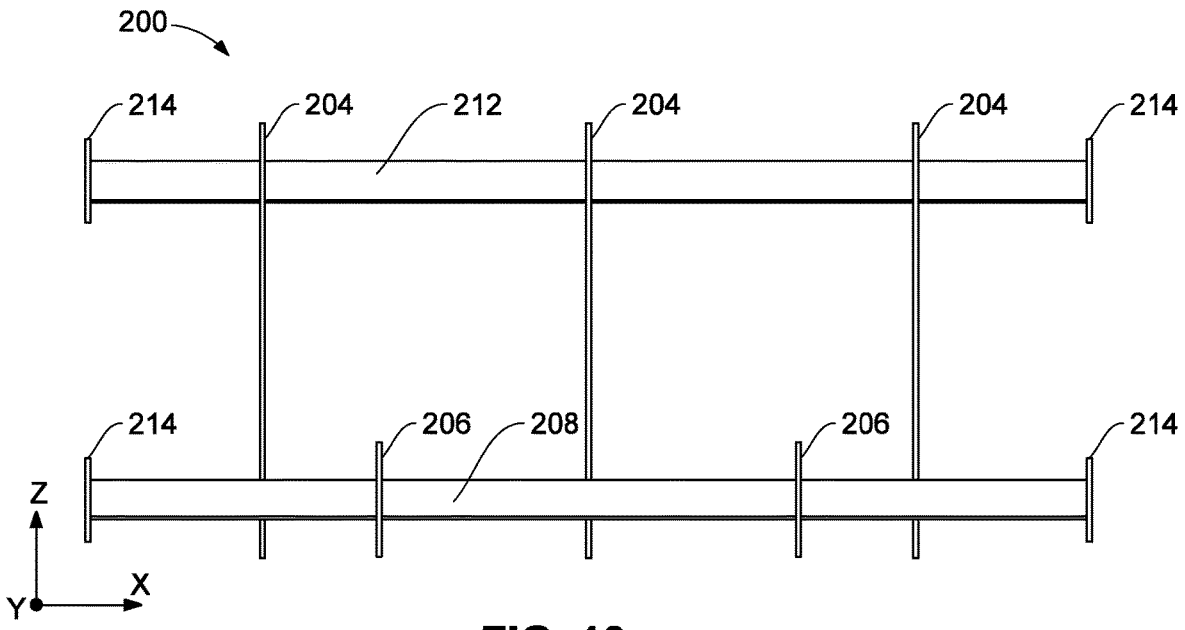
FIG. 10 illustrates a front view of the baffle assembly of FIG. 9.

FIG. 8 illustrates a perspective view of tank 100 with cover 104 removed to expose a baffle assembly 200 mounted with base 102 and disposed within inner volume 101. FIG. 9 illustrates perspective assembly of baffle assembly 20 removed from base 102. FIG. 10 illustrates a front view of baffle assembly removed from base 102. Baffle assembly 200 is configured to prevent the liquid held in volume 101 from extreme sloshing movements during transport. Thus, by preventing the sloshing, baffle system 200 protects against strong liquid impact loads imparted against the various components of the tank 100, and thereby protects the tank from the movements of the liquid during transport. In the illustrated embodiment, baffle assembly 200 comprises three vertical baffle plates 204 disposed in a vertical section of inner volume 101 and two horizontal plate 206 disposed within a horizontal section of volume 101. Those with skill in the art will understand that, in other embodiments, baffle assembly 200 includes more or less than the number of baffle plates 204, 206 shown. In some embodiments, depending on the overall form factor or shape of tank 100, vertical baffle plates 204 may be the same shape and size as horizontal plates 206. Thus, in these embodiments, plates 204, 206 can be irreplaceably used as either vertical or horizontal baffle plates. In other embodiments, vertical baffle plates 204 have different shapes and dimensions than horizontal baffle plates 206.

Baffle assembly 200 further comprises mounting beams 208, 210, 212 configured to mount the baffle plates 204, 206 within the inner volume 101. Specifically, there is: a front mounting beam 208 coupled with distal ends of baffle plates 206; a rear mounting beam 210 coupled with proximal ends of baffle plates 206, 204; and a top mounting beam 212 coupled with distal ends of baffle plates 204. Each end of mounting beams 208-212 is coupled with a side wall 170, 172 of tank 100. Specifically, as previously discussed, side sections 110 and 114 are welded together at edges 124, 128, and thus form a first side wall 170 of tank 100. Similarly, as previously discussed, side sections 112 and 116 are welded together at edges 126, 130, and thus form a second side wall 172 of tank 100. In some embodiment, each end of each beam 208-212 is first coupled with a puck plate 214. Thus, the end of each beam is welded with puck plate 214, and the puck plate is welded with wall 170, 172. As will become clear in the reading of this description, baffle assembly 200 is completely mounted within tank 100 using only mounting beams 208-212. I.e., no other part of baffle assembly 200, other than beams 208-2012 and/or puck 214, make direct contact with walls of the tank 100. That is to say, baffle plates 204, 206 are free from direct contact with any of the walls of tank 100.

Further, FIG. 8 shows fluid access assemblies 216, 218 configured to be used by a user to access liquid held in volume 101, which will be discussed in greater detail below. Fluid access assembly 216 is configured to interface with access hole 166 and fluid access assembly 218 is configured to interface with access hole 168. Fluid access assembly 216 is mounted, via welding in some embodiments, to back wall 106 and side wall 170, and fluid access assembly 218 is mounted, via welding in some embodiments, to back wall 106 and side wall 172.

Referring to FIGS. 9 and 10, for example, plates 204 and plates 206 are disposed in baffle assembly substantially parallel with each other along the z-axis. Additionally, as shown, each plate 204, 206 is mounted substantially orthogonally with its associated mounting beams 208-212. As shown, in some embodiments, plates 204 are staggard with plates 206 such that each plate 204 is disposed on different z-axis plane than each plate 206. However, in other embodiments a some of lates 204 and plates 206 are disposed on a same z-axis plane. Further, in some embodiments, instead of having vertical and horizontal baffle plates, baffle assembly 200 includes baffle plates that are generally L-shaped so as to occupy space in both the horizontal and vertical sections of the inner volume 101.

In some embodiments, baffle plates 204, 206 are made from steel having a gauge thickness of between 11-gauge and 14-gauge. However, in other embodiments, baffle plates 204, 206 are thicker than 11-gauge or thinner than 14-gauge. Additionally, in some embodiments, plates 204, 206 are made from a metal other than steel, such as aluminum, for example. In some embodiments, beams 208-212 are made by 2 inch by 1 inch angles steel beams. However, in other embodiments, beams 208-212 are made from beams of various shapes, sizes, and cross-sections other than the described angle beams without departing from the scope of this disclosure. Additionally, in some embodiments, beams 208-212 are made from a metal other than steel, such as aluminum, for example.

Figure 11:
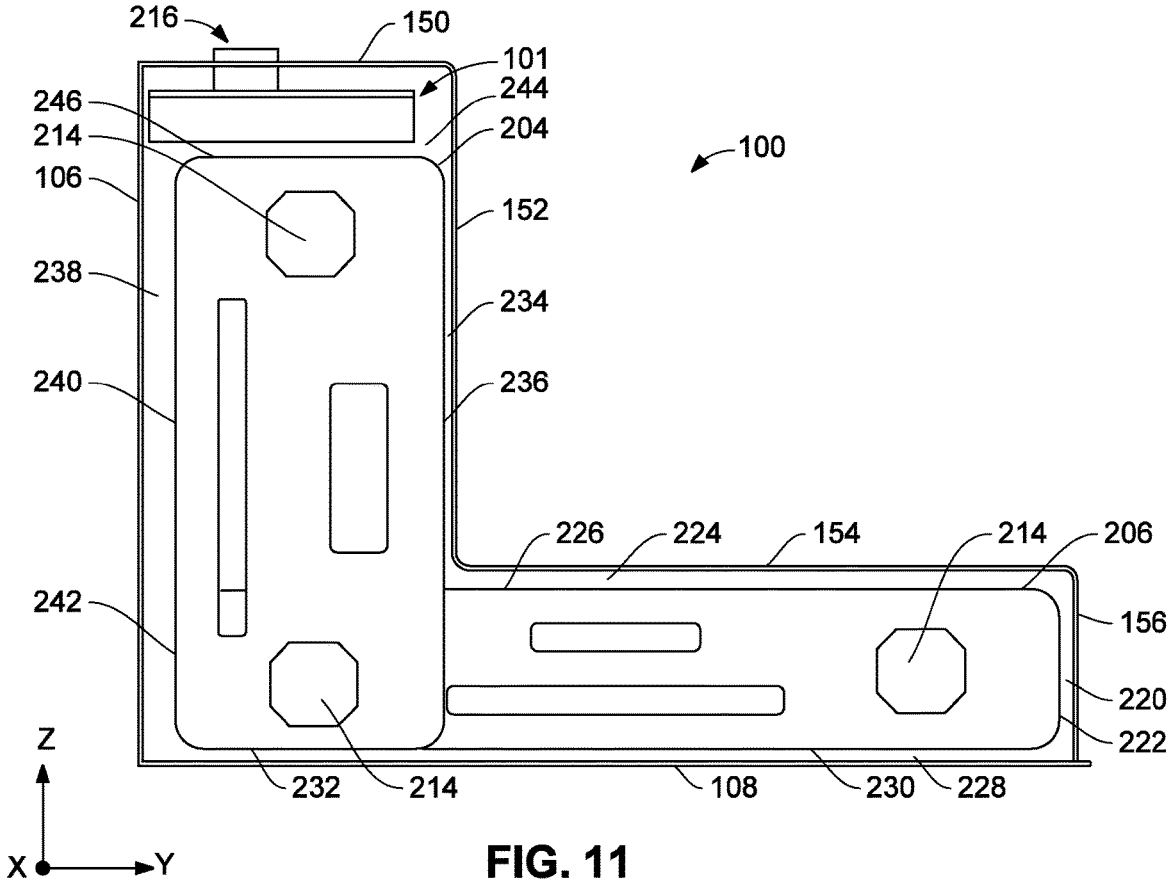
FIG. 11 illustrates a side cut view of the tank of FIG. 1 to show the baffle assembly.

FIG. 11 illustrates a side cut view of tank 100, cut where pucks 214 are coupled with side wall 170. As previously discussed, baffle plates 206 are referred to as horizontal plates because they are horizontally oriented and disposed in a horizontal section of inner volume 101. Specifically, as those with skill in the art will recognize, the horizontal section of inner volume is a section of inner volume 101 generally defined by front wall 156, middle wall 154, bottom wall 108, back wall 106, and side walls 170, 172. Baffle plates 204 are referred to as vertical plates because they are vertically oriented and disposed in a vertical section of inner volume 101. Specifically, as those with skill in the art will recognize, the vertical section of inner volume is a section of inner volume 101 generally defined by middle wall 156, bottom wall 108, back wall 106, top wall 150, and side walls 170, 172.

As shown, and as previously mentioned, baffle assembly 200 is mounted within inner volume 101 such that none of the baffle plates 206, 204 contact any of the walls of the tank. As shown, a number of gaps are formed between the edges of plates 204, 206 and the various adjacent walls of the tank 100. As shown, there is a gap 220 formed between a front edge 222 of plates 206 and front wall 156. There is a gap 224 formed between a top edge 226 of plates 206 and middle wall 154. There is a gap 228 formed between bottom edge 230 of plates 206, bottom edge 232 of plates 204, and base wall 108. There is a gap 234 formed between a front edge 236 of plates 204 and middle wall 152. There is a gap 238 formed between back edge 240 of plates 204, back edge 242 of plates 206, and back wall 106. Finally, there is a gap 244 formed between a top edge 246 of plates 204 and top wall 150. In some embodiments, gap 244 may be substantially larger than the other noted gaps to accommodate fluid access assemblies 216 and 218. Gaps 220, 224, 228, 234, 238 may vary in size according to various embodiments of this disclosure, according to some embodiments, gaps 224, 228, 234, 238 are generally within the range of 0.25 to 3 inches from the associated plate 204, 206 edge to the adjacent tank wall. However, those with skill in the art will understand that gaps less than 0.5 inch and greater than 3 inches fall within the scope of this disclosure. In some preferred embodiments, gaps 224, 228, 234, 238 are 0.75 inch.

The continuous gaps 224, 228, 234, 238 incorporate a number of inventive aspects. Traditionally, similar tanks incorporate baffles by welding the edges of the baffle plates directly to the inner surfaces of the walls of the tank. In these traditional designs, when the baffle plates are subjected to sloshing loads from the liquid, the baffles fail along the welded connection to the tank wall, and often damage or tear the baffle plate and/or the walls of the tank. Baffle assembly 200 utilizes beams 208-212 for mounting the baffle plates 204, 206 within inner volume 101, thereby forming continuous gaps 224, 228, 234, 238 and each baffle plate 204, 206 to be free from direct contact and connection with any of the walls of the tank. Additionally, gaps 224, 228, 234, 238 allow for improved liquid flow past the baffles 204, 206 of the liquid held in inner volume 101.

Figure 12:
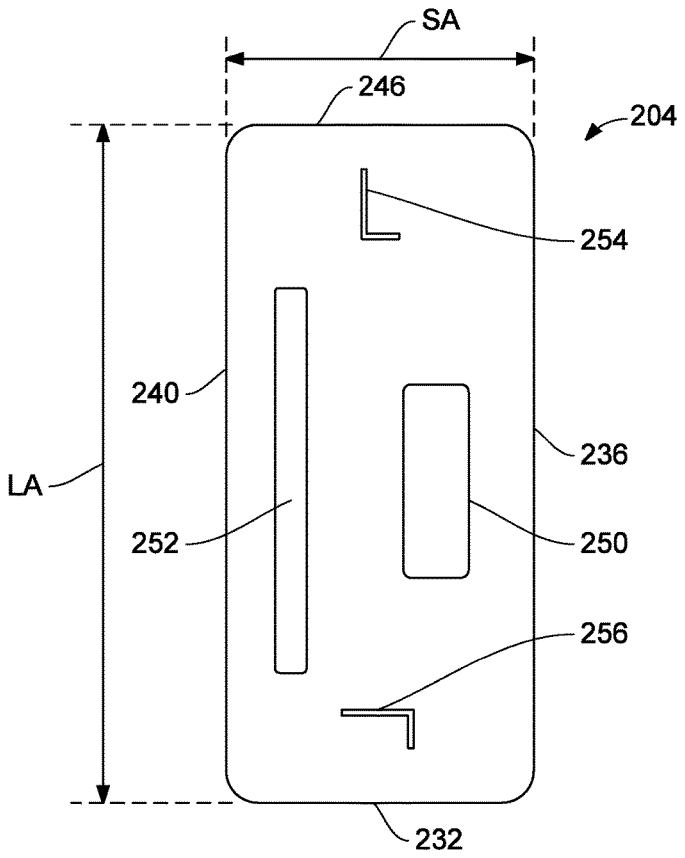
FIG. 12. illustrates a vertical baffle plate of the baffle assembly of FIG. 9.

FIG. 12 illustrates a side view of vertical baffle plate 204, which is generally rectangular in shape having a long axis LA and a short axis SA. As previously discussed, baffle plate 204 has outer edges 232, 236, 240, 246. Additionally, in some embodiments, baffle plate 204 further includes fluid passage hole, such as holes 250, 252. Holes 250, 252 are configured to allow for improved liquid flow past plat 204 within inner volume 101. As shown, plate 204 has two holes 250, 252, but other embodiments have more or less than two holes. Further, some embodiments do not incorporate holes, as fluid flow past plate 204 is sufficiently allowed for by gaps 224, 228, 234, 238, as previously discussed. Holes 250, 252 are generally rectangular in shape, however those with skill in the art will understand that holes 250, 252 can constitute any shape without departing from the scope of this disclosure. Additionally, plate 204 comprises mounting beam hole 254 located on a distal end of plate 204 along the long axis LA and mounting beam hole 256 located on a proximal end of plate 204 along the long axis LA. The holes 254, 256 are configured to be used for coupling plate 204 with beams 210, 212. Specifically, hole 254 is configured to be coupled with top beam 212. As previously discussed, beam 212 is an L-shaped angled beam. The L-shape of beam 212 is configured to be aligned with the corresponding L-shape of hole 254 and be inserted though hole 254 until plate 204 is positioned on beam 212 in its final position (as shown in FIGS. 8-10). Plate 204 is then welded to beam 212 around hole 254. Analogously, the L-shape of beam 210 is aligned with the L-shape of hole 256 and inserted through hole 256 until plate 204 is positioned on beam 212 in its final position, and then welded in place on beam 210 around hole 256.

Figure 13:
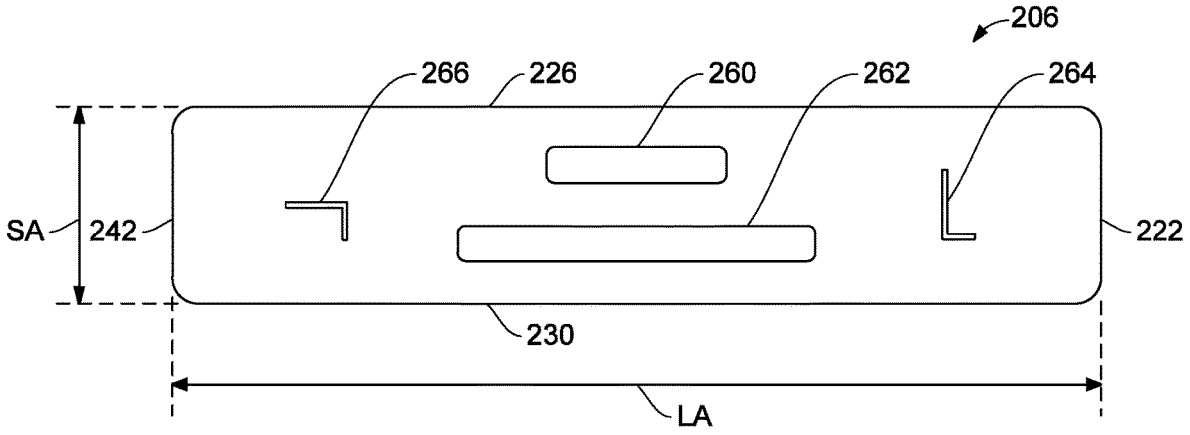
FIG. 13 illustrates a horizontal baffle plate of the baffle assembly of FIG. 9.

FIG. 13 illustrates a side view of horizontal baffle plate 206, which is generally rectangular in shape having a long axis LA and a short axis SA. As previously discussed, baffle plate 206 has outer edges 222, 226, 230, 242. Additionally, in some embodiments, baffle plate 206 further includes fluid passage hole, such as holes 260, 262. Holes 260, 262 are configured to allow for improved liquid flow past plat 206 within inner volume 101. As shown, plate 206 has two holes 260, 262, but other embodiments have more or less than two holes. Further, some embodiments do not incorporate holes, as fluid flow past plate 206 is sufficiently allowed for by gaps 224, 228, 234, 238, as previously discussed. Holes 260, 262 are generally rectangular in shape, however those with skill in the art will understand that holes 260, 262 can constitute any shape without departing from the scope of this disclosure. Additionally, plate 206 comprises mounting beam hole 264 located on a distal end of plate 206 along the long axis LA and mounting beam hole 266 located on a proximal end of plate 204 along the long axis LA. The holes 264, 266 are configured to be used for coupling plate 206 with beams 208, 210. Specifically, hole 264 is configured to be coupled with front beam 208. As previously discussed, beam 208 is an L-shaped angled beam. The L-shape of beam 208 is configured to be aligned with the corresponding L-shape of hole 264 and be inserted though hole 264 until plate 206 is positioned on beam 208 in its final position (as shown in FIGS. 8-10). Plate 206 is then welded to beam 208 around hole 264. Analogously, the L-shape of beam 210 is aligned with the L-shape of hole 266 and inserted through hole 266 until plate 204 is positioned on beam 212 in its final position, and then welded in place on beam 210 around hole 256. As shown, hole 266 of plate 206 is positioned in the same orientation of hole 256 of plate 204, as beam 210 is configured to pass through holes 266 and holes 256.

Figure 14:
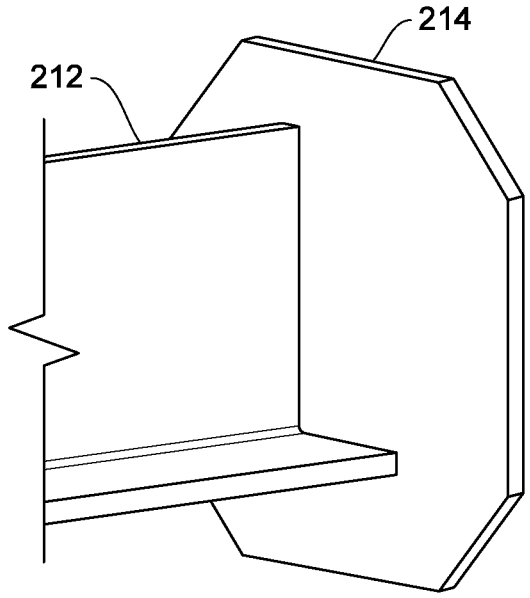
FIG. 14 illustrates a perspective view of a puck plate coupled with a mounting beam of the baffle assembly of FIG. 9.
Figure 15:
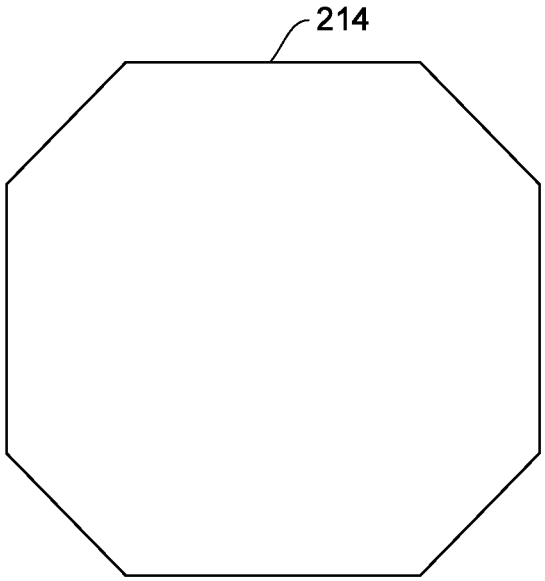
FIG. 15 illustrates the puck plate of FIG. 14.

FIG. 14 illustrates a perspective view of puck plate 214 coupled with mounting beam 212. Although FIG. 14 shows just one of the pucks 214 of thank 100, those with skill in the art will understand that the other pucks 214 and their connection to their corresponding mounting beam 208-212 is substantially the same as the puck described in FIG. 15. A front view of puck plate 214 is shown in FIG. 15. As shown and as previously discussed, in some embodiments, each end of each mounting beam, 208-212 is coupled with an inner-facing surface of the puck 214, and an outer-facing surface of the puck 214 is coupled with side wall 170, 172 of tank 100. In some embodiments, beam 208-212 is welded with puck plate 214, and puck plate 214 is welded with side wall 170, 172. The use of puck plates 214 between the beam ends and the tank wall presents various benefits over welding the beams directly with the tank wall. For example, the welding of the ends of beam 208-212 to its mating surface requires making many densely located welding locations around the L-shape of the beam 208-212. In practice, these dense weld point locations can often cause damage to the mating surface. Thus, in some embodiments, it is preferable to first weld the beams 208-212 with pucks 214 than with wall 170, 172 so as to avoid damaging the wall 170, 172. Since puck plate 214 has a much greater surface area and circumference than the end of beam 208-212, it provides better welding location for mounting the beam 208-212 to wall 170, 172 that, in practice, are less likely to cause damage to walls 170, 172 during the welding/mounting process. As shown, in some embodiments puck plate 214 has a generally octagonal shape, however, puck 214 can comprise any of a number of shapes without departing from the scope of this disclosure. In some embodiments, puck 214 is made from steel, such as 11-gauge steel, for example. In other embodiments, puck 214 is made of steel sized thicker or thinner than 11-gauge. In some embodiments, puck 214 is made from or comprises aluminum.

Figure 16:
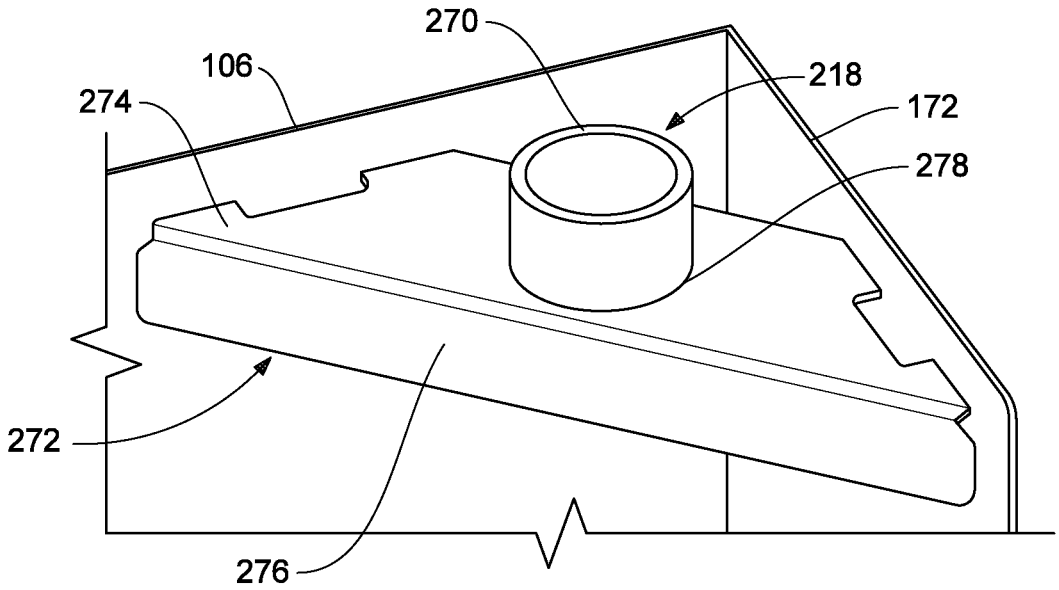
FIG. 16 illustrates a fluid access point of the tank mounted with a base of a tank, according to an embodiment in this disclosure.

FIG. 16 illustrates a perspective view of liquid access assembly 218 mounted to back wall 106 and side wall 172, and specifically to section 112. Although liquid access assembly 218 is described, in some embodiments, liquid access assembly 216 is substantially the same as liquid access assembly 218 and mounted within tank 100 in substantially the same manner as described. Liquid access assemblies 216, 218 can also be referred to herein as liquid or fluid access ports. Liquid access assembly 218 (and liquid access 216) comprises a merchant coupler 270. As those with skill in the art will recognize, merchant couplers have a threaded interior that are configured to be coupled with a threaded exterior of a corresponding male-counterpart of the merchant coupler. Here, merchant coupler 270 is configured to be coupled with a pump system configured to draw liquid held within inner volume 101. Specifically, a pump assembly import nozzle can be coupled to and inserted through coupler 270 to access inner volume 101.

As shown, coupler 170 is coupled with a mounting bracket 272. Mounting bracket 272 is generally an L-shaped bracket having a top surface 274 and a front surface 276. Top surface 274 has a through hole 278 in which coupler 270 is coupled to allow for fluid access to liquid held by inner volume 101. The ends of bracket 272 are coupled with walls 106 and 172 (and wall 170 for assembly 216), such as by welding for example, in order to mount the assembly 218, 216 within tank 100. In some embodiments, bracket 272 is made from steel, such as 11-gauge steel, for example. In other embodiments, bracket 272 is made of steel sized thicker or thinner than 11-gauge. In some embodiments, bracket 272 is made from or comprises aluminum. In some embodiments, bracket 272 is a 4"×1" bracket, where top surface 274 has a four inch width and front surface 276 has 1 inch width, however, various other bracket sizes fall within the scope of this disclosure. In some embodiments, merchant coupler 270 is a two-inch coupler and is made of steel. In other embodiments, coupler 270 has a working diameter of greater or less than two inches. In some embodiments, merchant coupler 270 is made from aluminum or another material.

Figure 17:
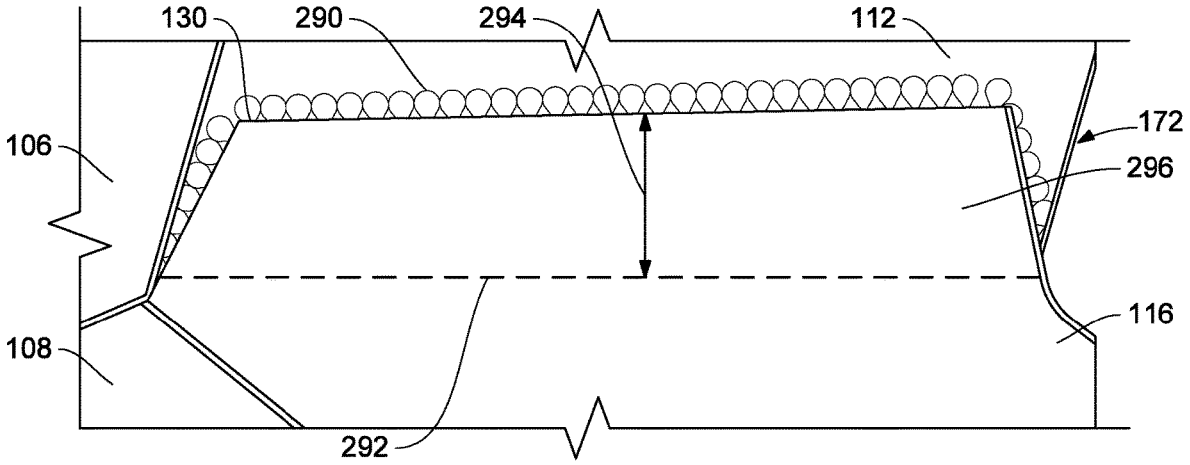
FIG. 17 illustrates an internal weld of a side wall of a tank, according to an embodiment of this disclosure.
Figure 18:
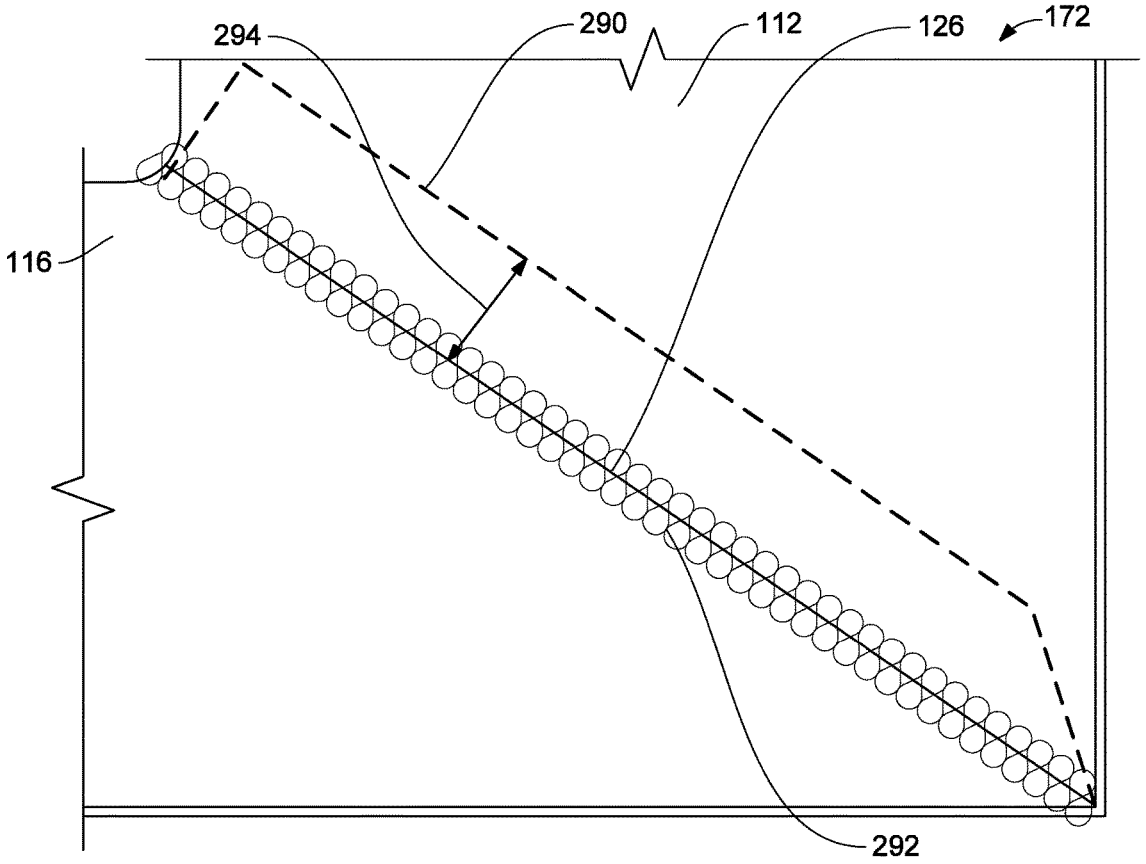
FIG. 18 illustrates an exterior weld of the side wall of FIG. 17.

FIGS. 17 and 18 show one embodiment of how edges of side sections 112 and 116 are welded together to form side wall 172. Those with skill in the art will understand that side wall 170 and its side sections 110 and 114 are formed in substantially the same way as wall 172, and that the same welds are not shown for 170 in order to lessen redundant descriptions. Specifically, FIG. 17 shows an interior view of wall 172 showing an interior wall weld bead 290 formed along edge 130, and FIG. 18 shows an exterior view of wall 172 showing an exterior wall weld bead 292 formed along edge 126. In FIG. 17, the location of exterior weld 292 is illustrated with dashed line 292, and in FIG. 18, the location of interior weld 290 is illustrated with dashed line 290.

As shown, in some embodiments, in the folded or bent position of base 102, the edges of wall 116 and wall 112 are configured to overlap one another by an overlapping distance 294. In some preferred embodiments, the overlapping distance is approximately 2 inches, although those with skill in the art will understand that the overlapping distance 294 can be greater or less than 2 inches without departing from the scope of this disclosure. As shown, in some embodiments, the sections 116, 112 are overlapped such that edge 130 is disposed in the interior of the tank 100 against the inner-facing surface of section 112, and such that edge 126 is disposed on the exterior of the tank 100 against the outer-facing surface of section 116. However, those with skill in the art will recognize that the opposite is also included as part of this disclosure (i.e., edge 126 disposed in the interior of tank 100 and edge 130 disposed on the exterior of the tank 100). As shown, in some embodiments, edge 130 is substantially extended by the overlap distance 294 to allow section 116 and section 112 to overlap. That is, section 116 can comprise an overlap extension section 296 protruding by length 294 to allow for the section 112, and 116 to overlap by the distance 294 when the base 102 is in the folded or bent position.

To sealingly couple sections 116 and 112, and thereby form side wall 172, weld bead 290 is formed along edge 130 and the inner surface of section 112, and weld bead 292 is formed along edge 126 and the outer surface of section 116. However, in some embodiments, only one of either weld 290 or weld 292 is formed in order to sealingly coupled the section 112, 116. As stated, side wall 170 has welds substantially the same as welds 290, 292 for its side sections 110, 114. Although FIGS. 17 and 18 show one configuration for coupling sections 112 and 116, those with skill in the art will recognize that the sections 112 and 116 can be coupled using any of various configurations and welding techniques, including the various configurations and techniques previously discussed herein, without departing from the scope of this disclosure.

Figure 19:
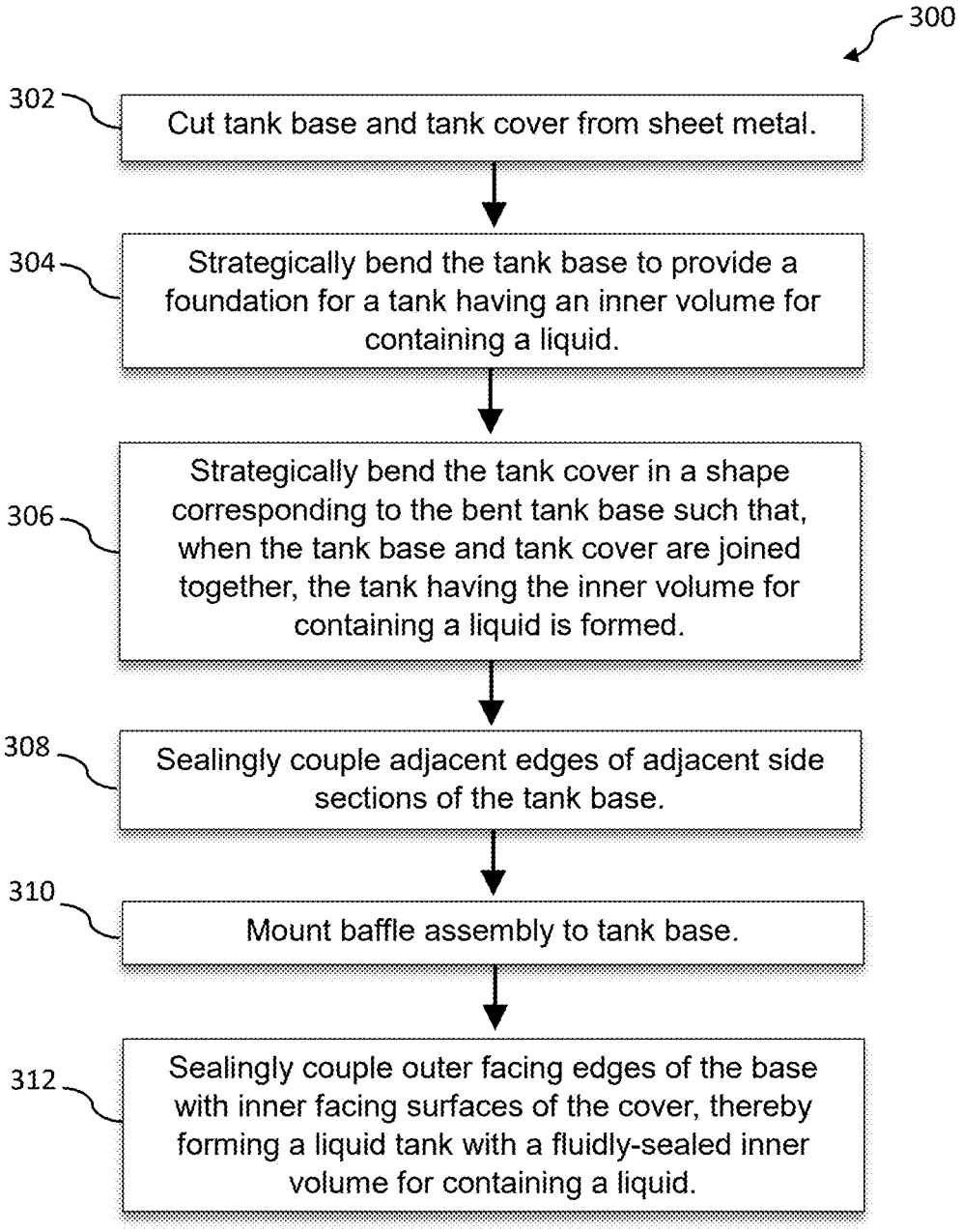
FIG. 19 is a flowchart illustrating a method of manufacturing a fluid tank of this disclosure, such as, for example, the fluid tank of FIG. 1.

FIG. 19 is a flowchart illustrating a method 300 for manufacturing a fluid tank of this disclosure, such as, for example, fluid tank 100. Method 300 can begin at block 302 by cutting base 102 and cover 104 from pieces of sheet metal and thereby create base 102 and cover 104 in their unbent state, as illustrated in FIGS. 2 and 5, respectively. Method 300 can continue to block 304 by strategically bending base 102 to transform the base 102 to its bent state for providing a foundation for tank 100. Specifically, for base 102, block 304 can include bending side sections 110 and 114 about axis 118; bending side section 112 and 116 about axis 120; and bending back section about axis 122, according to the descriptions previously disclosed. Method 300 can continue to block 306 by strategically bending cover 104 to transform the cover 104 to its bent state for forming tank 100. Specifically, for cover 104, block 306 can include bending top section 50 about axis 160; bending middle sections 152, 154 about axis 162; and bending front section 156 about axis 164, according to the descriptions previously disclosed. Those with skill in the art will understand that are various orders in which blocks 304 and 306 can be performed. For example, according to various embodiments, the blocks 304-306 are performed simultaneously, in other embodiments block 304 is performed before block 306, and in other embodiments block 306 is performed before block 304. Additionally, those with skill in the art will understand that the performance of block 304 and 306 may be performed at different times throughout the entire method 300. For example, in some embodiments, block 306 can be performed any time before the cover 104 and 102 are coupled together (block 312), including immediately prior to this coupling.

Method 300 can continue to block 308 by sealingly coupling (such as, for example, by welding) notched edge 128 with notched edge 124, and notched edge 130 with notched edge 126. This can include forming welds 290, 292 for side wall 172 and analogous welds for side wall 170, as previously discussed in FIGS. 17 and 18. As previously discussed, according to some embodiments, block 308 includes welding and additional piece of sheet metal over the junction/seams formed by edges 128 and 24 and by edges 130 and 126.

Method 300 can continue to block 310 by mounting baffle assembly 200 to base 102, as has been previously discussed. Block 310 can include coupling baffle plates 204, 206 with beams 208-212 as has been previously discussed. Block 310 can include coupling beams 208-212 with puck plates 214, as has been previously discussed. Block 310 can include mounting baffle assembly 200 within base 102 as has been previously discussed.

Method 300 can continue to block 312 by sealingly coupling (such as, for example, by welding) outer-facing edges of base 102 with inner-facing surfaces of cover 104 and thereby forming tank 100 with a sealed inner volume 101 for containing a liquid. Specifically, block 312 can include welding edges 134, 136, 138 with the inner-facing surface of top section 150, as previously described. Block 312 can include welding edges 132, 140 with the inner-facing surface of vertical section 152, as previously described. Block 312 can include welding edges 148, 142 with the inner-facing surface of horizontal section 154, as previously described. Block 312 can include welding edges 144, 146, with the inner-facing surface of front section 156, as previously described. Block 312 can include welding edge 149 with an outer-facing surface of section 156, as previously described. Said another way, the described welds of block 310 can be T-joint welds, as previously discussed. The T-joint welds can include welded joints that are welded on both sides of the T-joint and can also include welds welded on just one side of the T-joint (such as from the outside of the tank, for example). In other embodiments, block 312 includes welding the identified outer edges of base 102 with the outer edges of the corresponding section of cover 104 (corner-joint welds) rather than with the inner-facing surfaces of cover 104 (T-joint welds).

Although method 300 has been described as occurring in a certain order, those with skill in the art will understand that blocks 302-312 can be performed in various orders without departing from the scope of this disclosure. Additionally, method 300 can include more or less blocks than 302-312 without departing from the scope of this disclosure.

Those with skill in the art will appreciate benefits presented by the tanks and methods presented herein. As previously discussed, tank 100 utilizes bends rather than welds at many of the major corners of the tank and thus has solid metal rather than welds at various areas of the tank experiencing high amounts of stress. Said another way, tank 100 moves much of the welding to areas of the tank with less stress than traditional tanks. Further, tank 100 incorporates T-joint welds, which are stronger and more robust than the corner-joint welds traditionally employed on similar tanks. Finally, tank 100 requires much less welding than traditional tank manufacturing methods. For example, tank 100 required less than 50% of the welding required when compared to some traditional tanks that are similarly sized and shaped. Additionally, tank 100 requires only two different pieces of sheet metal (base 102 and cover 104), compared to four or more separate pieces of sheet metal required by traditionally shaped and sized tanks. As previously discussed, less welding not only reduces the amount of time and cost involved in manufacturing the tank, but also presents less opportunities for failure at the weld locations.

Additionally, as previously discussed, tank 100 incorporates a suspended baffle assembly 200 mounted completely within inner volume 101 by beams 208-212 being coupled with side walls 170, 172 rather than the traditional method of welding baffle plates directly to walls of a tank. Baffle assembly 200 is more robust than traditional baffles in that it is better suited for withstanding sloshing forces applied against the baffles by the liquid carried in inner volume 101 during travel. The junction of traditional baffle plates with the tank wall is torn by the torque applied to the junction from the sloshing forces applied against the baffle. Baffle assembly 200 suspends all baffle plates 204-206 within inner volume 101 such that the baffle plates 204-206 are free from direct contact with the walls of the tank 100 to address the noted deficiencies with traditional baffles.

Those with skill in the art will understand that base 102, cover 104, and baffle plates 204, 206 can be cut from any of a number of different types of sheet metal. For example, in some preferred embodiments, base 102, cover 104, and baffle plates 204, 206 are made from 14-gauge to 11-gauge carbon steel. However, those with skill in the art will understand that other gauge types fall within the scope of this disclosure. In some preferred embodiments, base 102, cover 104, and baffle plates 204, 206 are made from similarly gauged sheets of aluminum or aluminum alloys, however, those with skill in the art will understand that other gauge types fall within the scope of this disclosure. In some preferred embodiments, the described welds are made using MIG or TIG welding methods, as appropriate. However, those with skill in the art will understand that other weld types fall within the scope of this disclosure.

As has been discussed, tank 100 has a generally L-shaped cross section. This L-shape of tank 100 has various benefits in practice. For example, as has been discussed, the L-shape can allow for space savings in the pickup truck bed in which the tank 100 is mounted. For example, in some embodiments, a truck bed toolbox can be mounted in the L-shaped tank 100 by being seated within and coupled with the L-shape formed by tank middle horizontal and vertical walls 152, 154. However, those with skill in the art will understand that tanks of various shapes incorporating the inventive features discussed herein still fall within the scope of this disclosure. For example, some embodiments of this disclosure include tanks substantially similar to tank 100 but with square or rectangular cross-sections, for example. Additionally, although tank 100 has been described as mountable to the bed of a pickup truck, those with sill in the art will understand that tank 100 and other tanks of the disclosure can be used for various other purposes. For example, tanks of this disclosure can be used for transporting liquids using various vehicles. In addition to being mounted to pickup trucks, tanks of this disclosure can be mounted to various vehicles, for example, industrial vehicles, commercial vehicles, recreational vehicles, agricultural vehicles, vans, semitrucks, trailers, watercraft, and aircraft. In other embodiments, tanks of this disclosure are not mounted with a vehicle. That is to say, according to various embodiments, tanks of this disclosure are "stand alone" tanks not configured to transport liquid on a vehicle. As those with skill in the art will understand, any traditional means of mounting can be used for mounting tank 100 to the truck bed or other vehicle, such as, for example, mounting brackets coupled with rear wall 106, bottom wall 108, and/or side walls 170, 172.

Those with skill in the art will recognize that tank 100 can be sized to carry any of a number of different volumes. For example, in some embodiments, tank 100 is a 45-gallon tank. In some embodiments, tank 100 is anywhere from a 45- to 111-gallon tank. However, those with skill in the art will understand that various other tank sizes fall within the scope of this disclosure.

Although the present invention has been described in terms of the foregoing disclosed embodiments, this description has been provided by way of explanation only and is not intended to be construed as a limitation of the invention. Indeed, even though the foregoing descriptions refer to numerous components and other embodiments that are presently contemplated, those of ordinary skill in the art will recognize many possible alternatives exist that have not been expressly referenced or even suggested here. While the foregoing written descriptions should enable one of ordinary skill in the pertinent arts to make and use what are presently considered the best modes of the invention, those of ordinary skill will also understand and appreciate the existence of numerous variations, combinations, and equivalents of the various aspects of the specific embodiments, methods, and examples referenced herein.

Hence the drawings and detailed descriptions herein should be considered illustrative, not exhaustive. They do not limit the invention to the particular forms and examples disclosed. To the contrary, the invention includes many further modifications, changes, rearrangements, substitutions, alternatives, design choices, and embodiments apparent to those of ordinary skill in the art, without departing from the spirit and scope of this invention.

Accordingly, in all respects, it should be understood that the drawings and detailed descriptions herein are to be regarded in an illustrative rather than a restrictive manner and are not intended to limit the invention to the particular forms and examples disclosed. In any case, all substantially equivalent systems, articles, and methods should be considered within the scope of the invention and, absent express indication otherwise, all structural or functional equivalents are anticipated to remain within the spirit and scope of the presently disclosed systems and methods.

What is claimed is:

1. A method for manufacturing a vehicle-mounted tank with an inner volume for transporting a liquid, comprising:

cutting a tank base and a tank cover from sheet metal;

bending a first side section and a second side section of the tank base, disposed on a first side of the tank base, substantially ninety degrees about a first bend axis of the tank base;

bending a third side section and a fourth side section of the tank base, disposed on a second side of the tank base opposite of the first side of the tank base, substantially ninety degrees about a second bend axis of the tank base substantially parallel with the first bend axis;

bending an inner section of the tank base along a third bend axis substantially perpendicular with the first bend axis and the second bend axis to form a tank back section and a tank bottom section from the inner section, wherein the bending along the third bend axis further causes:

an inner edge of the first side section to contact or nearly-contact an inner edge of the second side section to form a first tank side wall, an inner edge of the third side section to contact or nearly-contact an inner edge of the fourth side section to form a second tank side wall, and the tank base to have a generally L-shaped cross-section;

bending the tank cover along a fourth bend axis, a fifth bend axis, and a sixth bend axis of the tank cover, each bend axis of the tank cover substantially parallel with the third bend axis, to form a top wall, a front wall, and a first middle wall and a second middle wall, wherein:

the first middle wall and the second middle wall generally form an L-shape, the top wall extends perpendicularly from the first middle wall, and the front wall extends perpendicularly from the second middle wall; and welding the inner edge of the first side section with the inner edge of the second side section;

welding the inner edge of the third side section with the inner edge of the fourth side section; and welding outer edges of the tank base with a bottom surface of the tank cover to form the tank with the inner volume.

2. The method of claim 1, further comprising, before welding the tank cover with the outer edges of the tank base, mounting a baffle assembly within the tank base.

3. The method of claim 2, wherein the baffle assembly comprises: a plurality of horizontal baffle plates disposed in a horizontal section of the inner volume; and a plurality of vertical baffle plates disposed in a vertical section of the inner volume.

4. The method of claim 2, wherein the mounting of the baffle assembly comprises welding a plurality of mounting beams of the baffle assembly with the first tank side wall and the second tank side wall.

5. The method of claim 4, wherein:

the baffle assembly comprises a plurality of baffle plates each coupled with at least some of the plurality of mounting beams; and the baffle assembly is mounted within the tank base such that each of the plurality of baffle plates are free from direct contact with any of the walls of the tank.

6. The method of claim 2, wherein each baffle plate of a plurality of baffle plates of the baffle assembly:

has a generally rectangular shape with a long axis and a short axis;

includes a first beam through-hole disposed on a first end of the baffle along the long axis and a second beam through-hole disposed on a second end of the baffle along the long axis; and is configured to be coupled with a mounting beam by inserting the mounting beam through the first beam through-hole and with another mounting beam by inserting the other mounting beam through the second beam through-hole.

7. The method of claim 2, wherein each baffle plate of a plurality of baffle plates of the baffle assembly comprises a liquid flow through-hole, though which liquid in the tank is configured to freely flow through the baffle plate.

8. The method of claim 2, wherein each baffle plate of a plurality of baffle plates of the baffle assembly is mounted within the inner volume to form a continuous gap between the baffle plate and the walls of the tank such that liquid held in the inner volume can freely flow past the baffle plate via the continuous gap.

9. The method of claim 1, wherein the welding of the outer edges of the tank with the bottom surface of the tank cover is performed using a T-joint welding method.

10. The method of claim 1, wherein the tank base and base cover are cut from steel sheet metal ranging from 11-gauge to 14-gauge.

11. The method of claim 1, further comprising forming at least one liquid access port in the top wall configured to allow access to the inner volume from outside of the tank.

* * * * *